US008308269B2

(12) United States Patent
Omer et al.

(10) Patent No.: US 8,308,269 B2
(45) Date of Patent: Nov. 13, 2012

(54) PRINT HEAD

(75) Inventors: Salhadin Omer, Cambridge (GB); Ammar Lecheheb, Cambridge (GB)

(73) Assignee: Videojet Technologies Inc.

( * ) Notice: Subject to any disclaimer, the term of this patent is extended or adjusted under 35 U.S.C. 154(b) by 329 days.

(21) Appl. No.: 12/708,142

(22) Filed: Feb. 18, 2010

(65) Prior Publication Data

US 2010/0207976 A1 Aug. 19, 2010

Related U.S. Application Data

(60) Provisional application No. 61/153,392, filed on Feb. 18, 2009.

(51) Int. Cl.
*B41J 2/015* (2006.01)

(52) U.S. Cl. ..... 347/20

(58) Field of Classification Search ..... 347/9, 29, 347/73, 74, 108, 109, 20
See application file for complete search history.

(56) References Cited

U.S. PATENT DOCUMENTS

| | | | | |
|---|---|---|---|---|
| 6,848,766 | B2 | 2/2005 | Garbacz et al. | |
| 6,890,053 | B2 | 5/2005 | Myhill et al. | |
| 7,237,875 | B2 * | 7/2007 | Hoisington et al. | 347/68 |
| 7,285,160 | B2 | 10/2007 | Zhu et al. | |
| 7,661,814 | B2 * | 2/2010 | Noe et al. | 347/109 |
| 2005/0288874 | A1 | 12/2005 | Qingguo et al. | |
| 2010/0238209 | A1 | 9/2010 | Omer et al. | |

* cited by examiner

*Primary Examiner* — An Do
(74) *Attorney, Agent, or Firm* — Joseph A. Yosick

(57) ABSTRACT

A print head assembly includes a print head and a print head cover disposed around the print head. The print head cover includes a face and a print opening disposed in the face. The print opening disposed adjacent an ejection point of the print head. A perforated area is disposed on the face.

21 Claims, 10 Drawing Sheets

PRINT HEAD

CROSS REFERENCE TO RELATED APPLICATIONS

This application claims priority to U.S. Provisional Application No. 61/153,392 filed Feb. 18, 2009, and incorporated herein by reference in its entirety.

BACKGROUND

The present disclosure relates to ink jet printing and more particularly to a print head assembly for use in an ink jet printer such as a continuous ink jet printer.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurized ink to a print head assembly, having a drop generator where a continuous stream of ink emanating from a nozzle is broken up into individual regular drops by an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. A phase measurement system is also usually present as part of deflection plate assembly and is used to ensure synchronization of deflection for the droplets. The charged drops bypass the gutter and hit the substrate at a position determined by the charge on the drop and the position of the substrate relative to the print head assembly. Typically the substrate is moved relative to the print head assembly in one direction and the drops are deflected in a direction generally perpendicular thereto, although the deflection plates may be oriented at an inclination to the perpendicular to compensate for the speed of the substrate (the movement of the substrate relative to the print head assembly between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

The heater in the print head assembly ensures that the viscosity of the ink, which varies with the ink temperature, is maintained at a value such that the drop generator in the print head assembly works effectively. If the ink is too viscous, because its temperature is too low, or too thin, because it is too hot, then the ink stream will not break up into suitable droplets.

Ink is delivered under pressure to the print head assembly from an ink supply system that is generally housed within a sealed compartment of a cabinet that includes a separate compartment for control circuitry and a user interface panel. The system includes a main pump that draws the ink from a reservoir or tank via a filter and delivers it under pressure to the print head assembly. As ink is consumed the reservoir is refilled as necessary from a replaceable ink cartridge that is releasably connected to the reservoir by a supply conduit. The ink is fed from the reservoir via a flexible delivery conduit to the print head assembly. Electrical power to operate the heater in the print head assembly and the drop generator are supplied by power supply system cables, typically forming part of the supply conduit The unused ink drops captured by the gutter are recirculated to the reservoir via a return conduit, typically located as part of the supply conduit, by a pump. The flow of ink in each of the conduits is generally controlled by solenoid valves and/or other like components.

As the ink circulates through the system, there is a tendency for it to thicken as a result of solvent evaporation. This is particularly a problem in relation to the recirculated ink that has been exposed to air in its passage between the nozzle and the gutter. In order to compensate for this "make-up" solvent is added to the ink as required from a replaceable solvent cartridge so as to maintain the ink viscosity within desired limits when the ink is at the correct operating temperature. This solvent may also be used for flushing components of the print head assembly, such as the nozzle and the gutter, in a cleaning cycle.

As the ink is ejected from the print head assembly, it is deposited on the substrate. However, a small portion of the ink typically is splashed back upon the face of the print head. The ink deposits accumulate on the face of the print head, eventually requiring the printer to be shut down for cleaning. Factors that influence the speed and amount of build up on the face of the print head include the throw distance, the substrate media, ink composition, the print time, and the print head design (including geometry, drop size and jet velocity).

BRIEF SUMMARY

The present disclosure provides a print head design suitable for continuous ink jet print head assemblies. The configuration of the print head cover reduces the amount of ink that builds up on the face of the print head, thus significantly reducing the need for cleaning the print head.

In one aspect, a print head assembly includes a print head and a print head cover disposed around the print head. The print head cover includes a face and a print opening disposed in the face. The print opening disposed adjacent an ejection point of the print head. A perforated area is disposed on the face.

In another aspect, a method of operating a print head includes providing a print head assembly. The print head assembly includes a print head and a print head cover. The print head cover includes a face. A print opening is disposed in the face adjacent an ejection point of the print head. Ink is provided to the print head and ejected from the ejection point of the print head through the print head cover. A flow of air is provided adjacent the ejection point from an interior of the print head assembly to an exterior of the print head assembly. Ink is deposited on a substrate.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
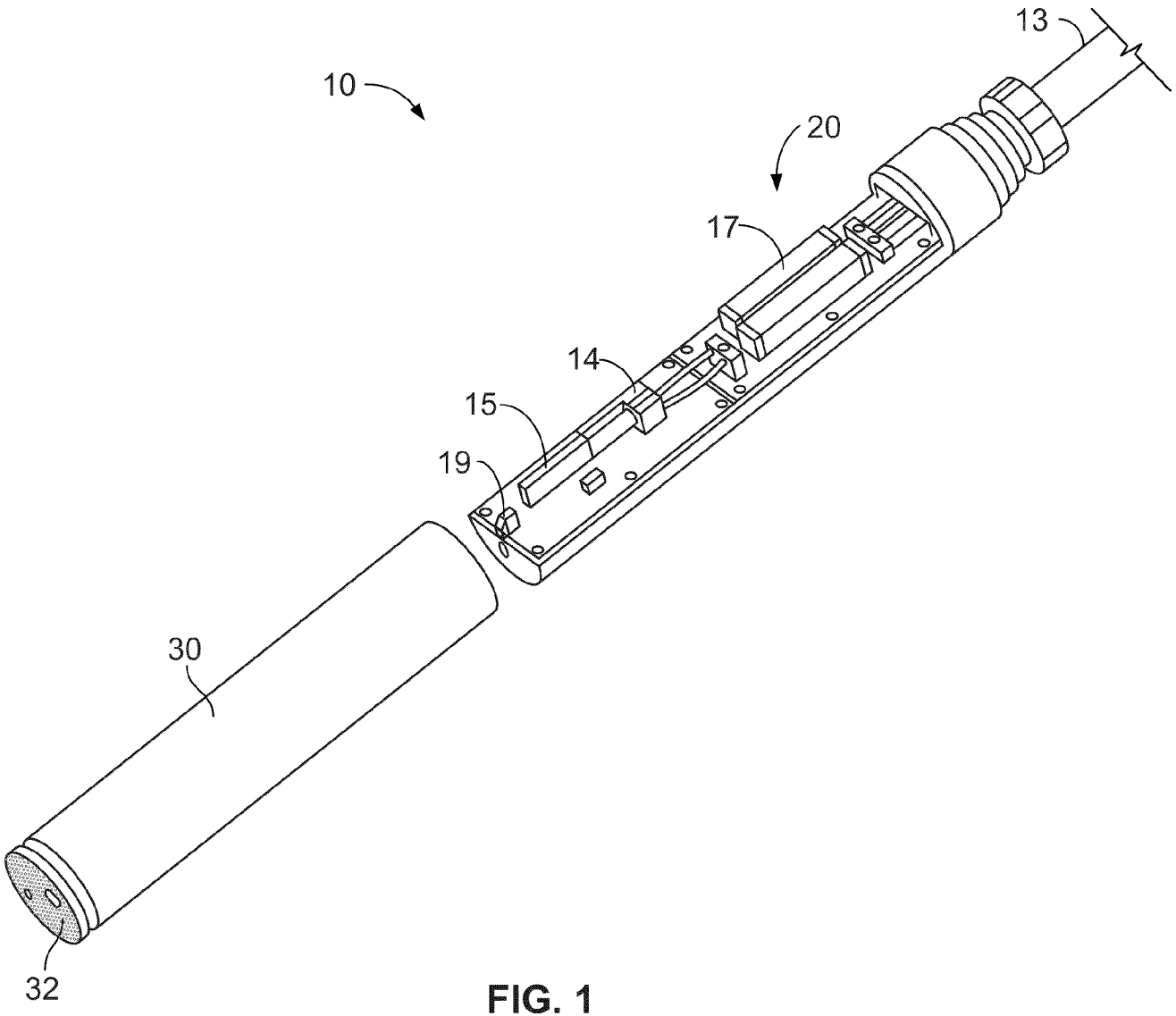
FIG. 1 is an exploded view of the components of an embodiment of a print head assembly.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a print head design suitable for continuous ink jet print head assemblies. The configuration of the print head cover reduces the amount of ink the builds up on the face of the print head, thus extending the service time period.

Figure 2:
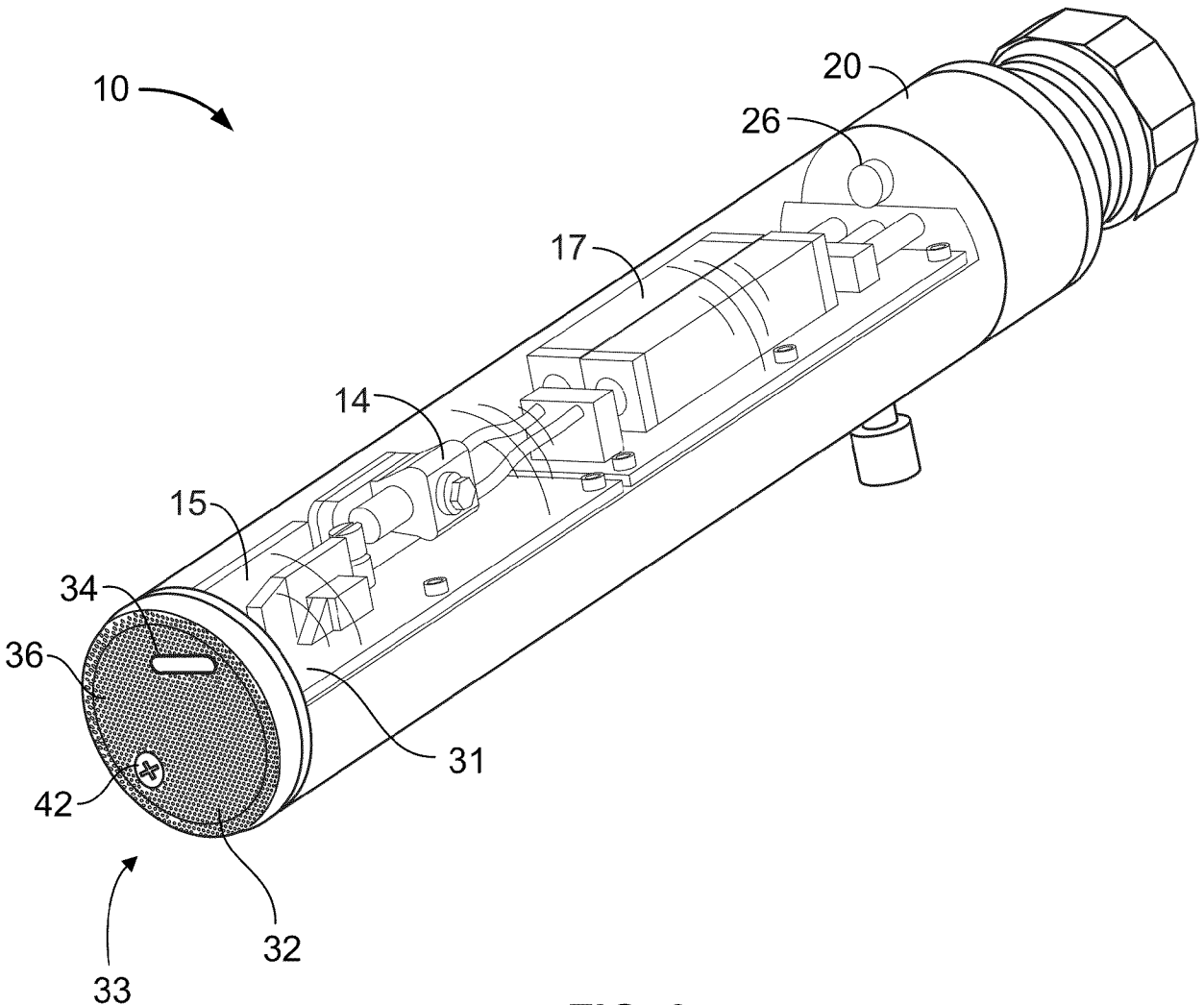
FIG. 2 is a view of the print head assembly of FIG. 1 with the print head cover shown as translucent.
Figure 3:
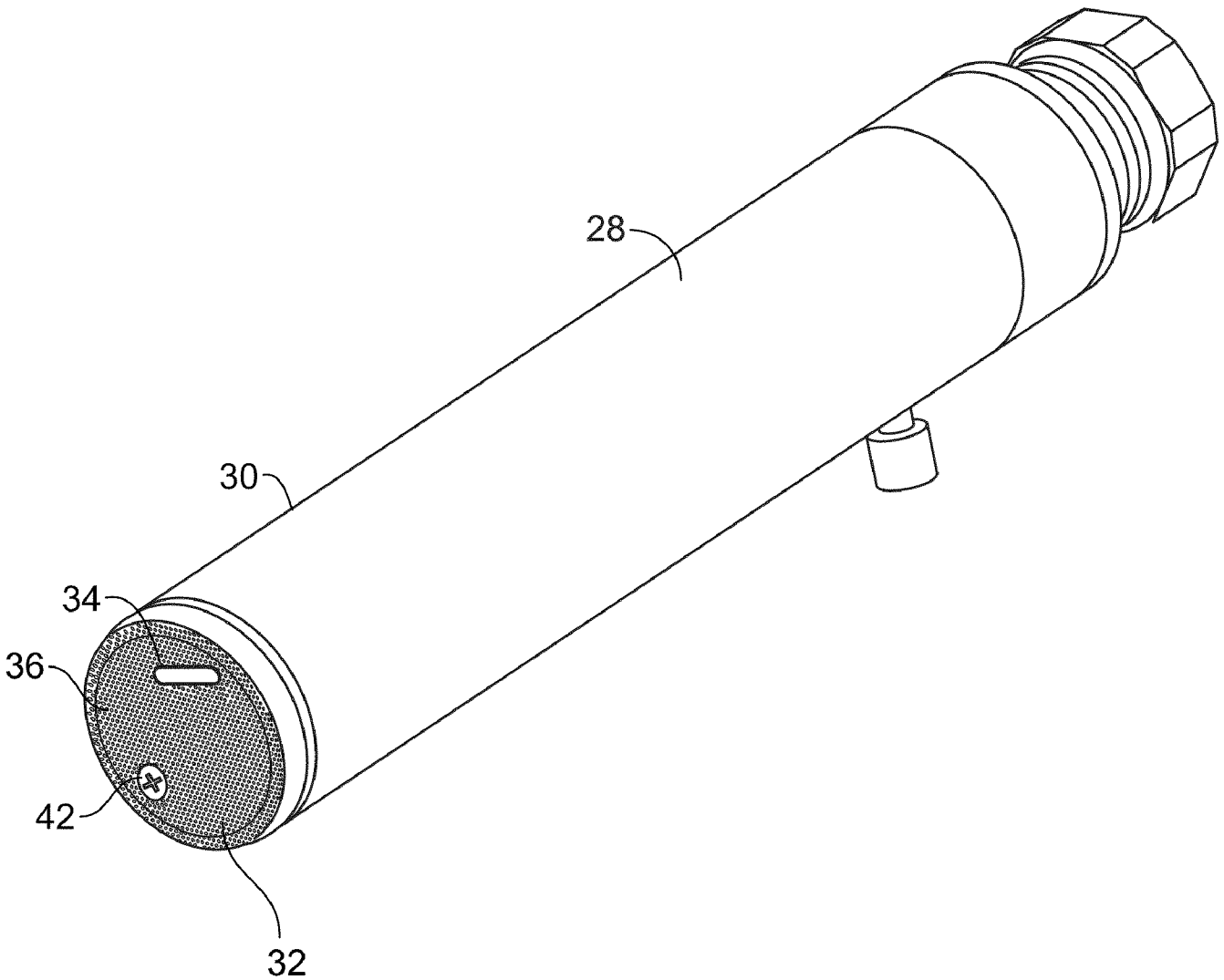
FIG. 3 is a perspective view of the print head assembly of FIG. 1.

FIG. 1 shows an exploded view of an embodiment of a print head assembly 10. The print head assembly 10 includes print head 20 and print head cover 30. As also seen in FIGS. 2 and 3, print head cover 30, which encloses the print head 20, includes a face 32 and a print opening 34 disposed in the face 32. The print opening 34 is disposed adjacent an exit point or nozzle of the print head 20. The present design includes a perforated area 36 disposed on the face 32. The perforated area 36 is preferably disposed adjacent to and around the print opening 34. The print opening 34 may be any suitable shape to allow ink to be ejected from the ejection point of the print head through the face 32 of the print head cover 30. Fastener 42 may be used to attach a proximity-sensor magnet (not shown) onto the print head cover 30.

In the embodiment shown in FIGS. 1-4, the print opening 34 is in the shape of an elongated rectangle with rounded ends. Other shapes of the print opening 34 are of course possible, such as square, rectangular, round, oval, etc. In use, a particular print head assembly may be oriented to eject ink in any suitable direction, including up, down, and sideways.

The print head 20 may use any suitable technology for expelling ink, including continuous ink jet, thermal ink jet, and piezoelectric ink jet. For example, the embodiment shown in FIG. 1 is a continuous ink jet system. One type of continuous ink jet system that the presently disclosed print head design may be used with is described in PCT Application Number US2008/079484, filed on Oct. 10, 2008, published as WO 2009/049130 A1, and titled "INK JET PRINTER HEAD ASSEMBLY," the entirety of which is hereby incorporated by reference. It has been found that by providing air flow through the perforated openings adjacent the ink flow path, the accumulation of ink and other debris on the print head face is substantially reduced, thus allowing longer run times without the need for maintenance or other operator intervention. The air flow is preferably provided directly adjacent the ink flow, e.g. less than 5 mm from the ink flow.

Referring now to FIGS. 1 and 2, a print head assembly 10 is connected to a supply conduit 13 linking the print head assembly 10 to the rest of the printer (not shown). The print head assembly 10 includes an ink droplet generator module 14 and heater module 17. The ink droplet generator module 14 may include such elements as a piezoelectric element acting as ink droplet generator, deflector plate assembly 15 including a charge electrode and deflector plates, a phase measurement system, a gutter, and an ejection point 19 from which the droplets are printed. When printing, ink passes through the supply conduit 13, through fluid pathways, through heater module 17, through ink droplet generator module 14 and eventually out of the print head assembly 10 adjacent the ejection point 19. The specific print head design shown in FIG. 1 is meant as just one example of a possible print head configuration, and the print head cover design disclosed herein is not limited to any particular print head mechanism.

Figure 4:
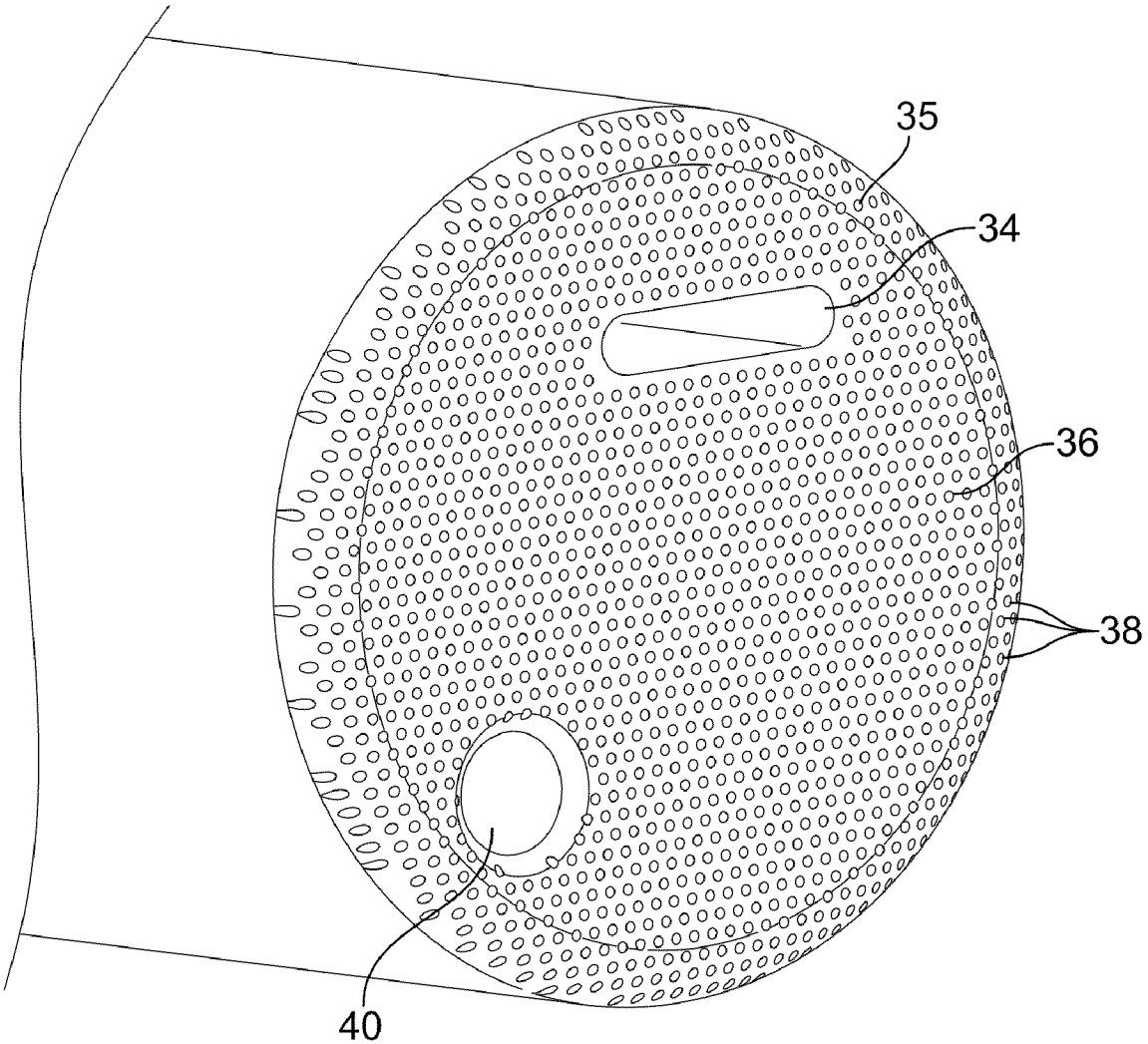
FIG. 4 is a perspective view of the face of the print head assembly of FIG. 1.

The face 32 of the print head assembly 10 is shown in detail in FIGS. 3 and 4. The print head face 32 may include a beveled edge 35 around its periphery. Perforated area 36 is disposed around print opening or slot 34. Ink from the print head 20 is ejected through slot 34. In one embodiment, the perforated area 36 includes a plurality of holes 38 disposed in the face 32. The holes 38 may be dimensioned between 0.4 mm and 1.2 mm in diameter, preferably around 0.5 mm to 1.0 mm in diameter. In the embodiment shown in FIG. 4, the perforated area 36 covers the entire area of the face 32, including beveled edge 35.

Although the perforated area 36 is shown in FIG. 4 as being composed of a plurality of holes 38, other opening shapes are possible. For examples, the holes could be shapes other than round, such as square, rectangular, oval, or triangular. Further, instead of holes, the perforated area 36 could include elongated slots. The purpose of the perforated area 36 is to provide air flow out of the print head assembly 10 adjacent to the print head opening 34, and it will be apparent that different shapes of openings may accomplish this goal. Using circular holes 38 for the perforated area 36 is useful because circular holes are an easy shape to provide. The holes may be fashioned in the face 32 by mechanical methods (such as drilling), by chemical etching, or by any other suitable method. Screw hole 40 is used to attach a proximity-sensor magnet onto the print head cover 30, and is not open once the print head 20 is assembled.

Figure 5:
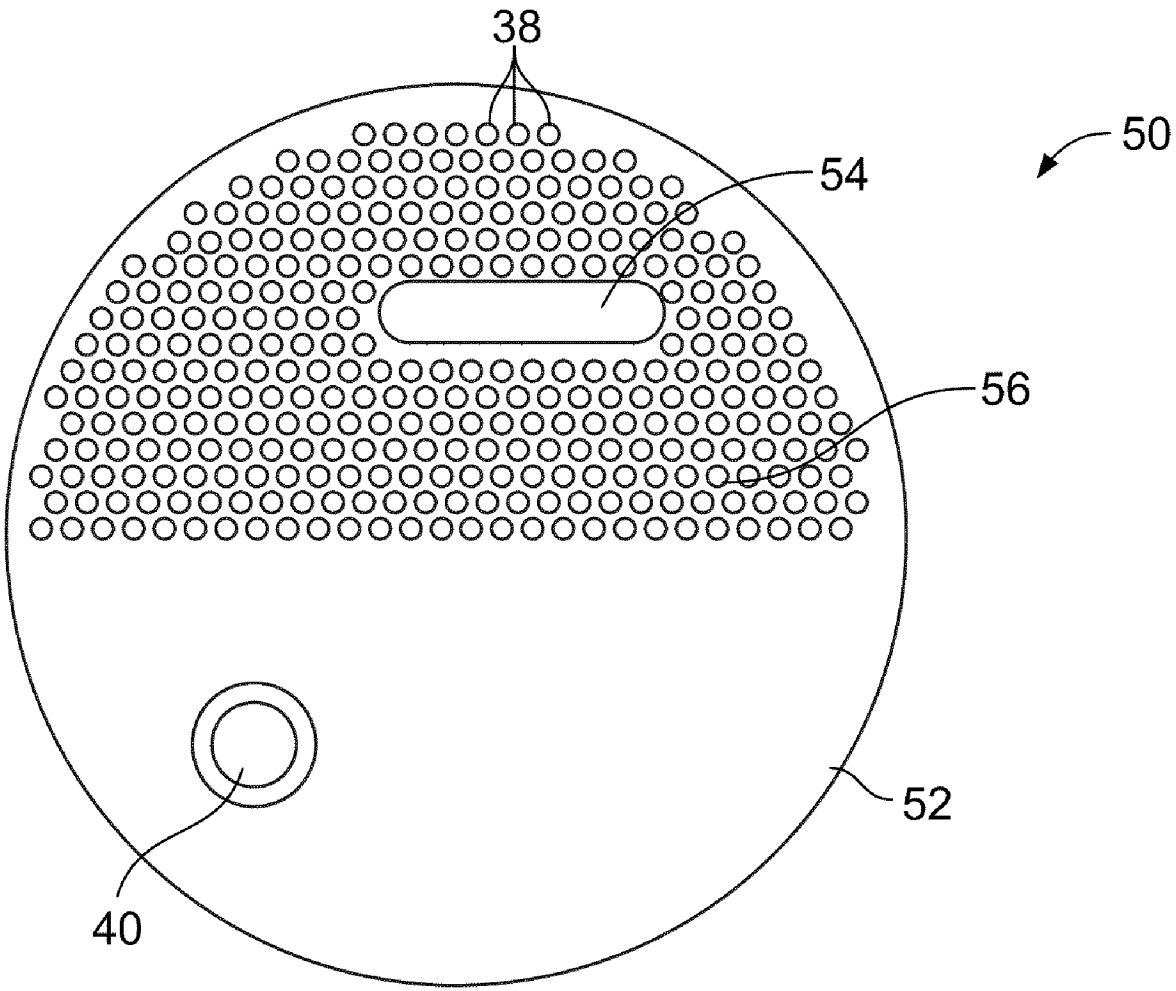
FIG. 5 is a front view of another embodiment of a print head assembly

FIG. 5 shows an alternative print cover design 50. Perforated area 56 is disposed around slot 54. In contrast to the design shown in FIG. 4, the perforated area 54 only covers a portion of the face 52. The perforated area 56 includes a plurality of holes 38 disposed in the face 52. In the alternative embodiment shown in FIG. 5, the perforated area 56 covers generally about 50% of the area of the face 52, and the perforated area 56 is in the shape of a semi-circle. In general, the perforated area 56 is disposed on at least 20% of the surface area of the face 52. In one embodiment, the perforated area 56 covers at least 25% of a surface area of the face. In another embodiment, the perforated area 56 covers at least 40% of a surface area of the face 52. In further embodiments, the perforated area 56 covers at least 60%, at least 80%, or at least 90% of the surface area of the face 52. The perforated area 56 preferably includes at least 10% and 40% open area, preferably around 15% open area. "Open area" is defined as the area of the holes or other openings, divided by the total surface area of the perforated area 56 of the face 52.

In the embodiment shown in FIG. 5, the face 52 is circular in shape and the perforated area 56 is generally semi-circular in shape. In one embodiment, the print head cover 30 or 50 is generally cylindrical in shape, with a cylindrical wall 28 perpendicular to the face 32 or 52 and surrounding the print head 20. The perforated area 56 is preferably disposed adjacent the print opening 54. However, the precise location of the perforated area 56 with respect to the print opening 54 may vary, depending on a variety of factors, including the geometry of the print head assembly, the type of print head, and design and manufacturing constraints. In another embodiment, shown in FIGS. 9 and 10 and described below, the print head cover is generally rectilinear in shape and the face is generally rectangular in shape.

The print head assembly 10 is preferably provided with pressurized air so that the air pressure in the interior 31 of the print head assembly 10 is greater than the ambient air pressure outside 33 of the print head assembly 10. This pressurization may be accomplished by any suitable method, including an air pump or compressed air from a conventional compressed air source. The air may enter the print head assembly 20 at any suitable point, such as through port 26 located within the print head cover 30. Thus, as may be seen in FIG. 2, the print head assembly 10 includes an interior volume 31 in fluid communication through the perforated area 36 with an outer volume or ambient environment 33, where the air pressure of the interior volume 31 is greater than the air pressure of the outer volume or ambient environment 33. The difference in air pressure between the interior volume 31 and the outer volume 33 is preferably large enough to generate sufficient airflow through the perforated area 36 and the print opening 34, while at the same time small enough to not significantly degrade the print quality. Thus, by flowing air through perforated area 36, the air flow adjacent the ink flow path is preferably provided integrally to the print head design. The air flow rate through the perforated area 36 is preferably at least about 5 $ft^3$/hr. The direction of air flow through perforated area 36 may be generally parallel to the ink flow path and generally perpendicular to the face 32. The air flow through perforated area 36 reduces the accumulation of ink and other debris on the print head cover 30. The same pressurized air conditions described above may apply for the other print head designs disclosed herein.

The print head 20 is preferably oriented along a central axis within the print head cover 30, as seen in FIG. 2. Thus, the ejection point 19 after deflection is oriented such that ink is ejected generally perpendicular to the face 32.

Figure 6:
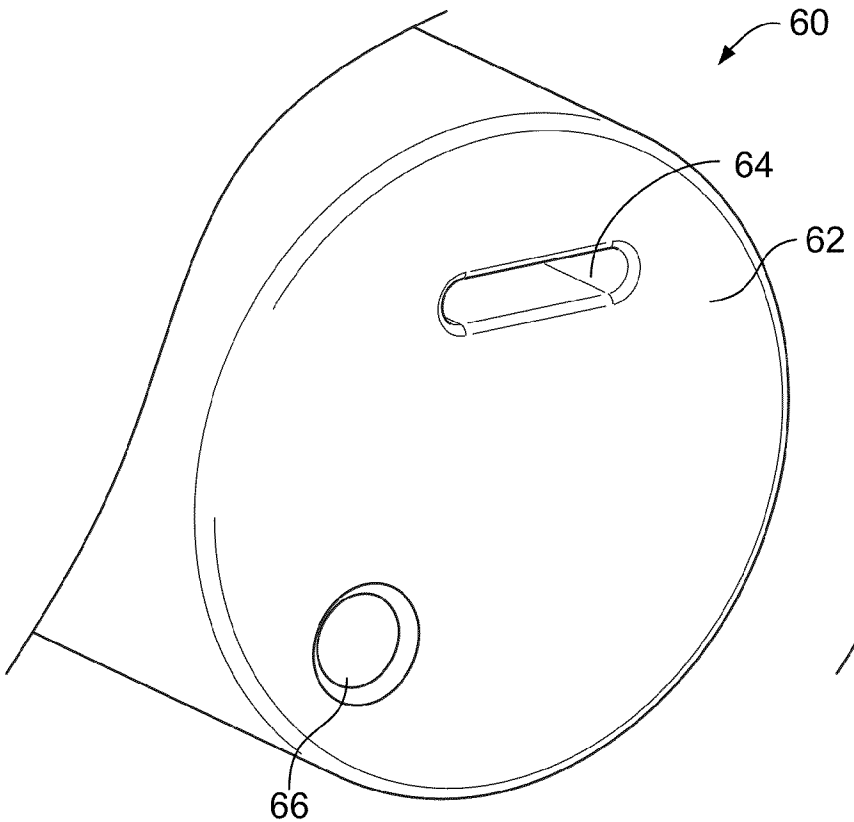
FIG. 6 (PRIOR ART)
FIG. 6 is a view of the face of a prior art print head assembly.

FIG. 6 shows the face 62 of the print head cover 60 of a conventional continuous ink jet printer. The only opening is slot 64, from which ink is ejected. Screw hole 66 is used to attach a proximity-sensor magnet onto the print head cover 30 and is not open during printing.

Figure 7:
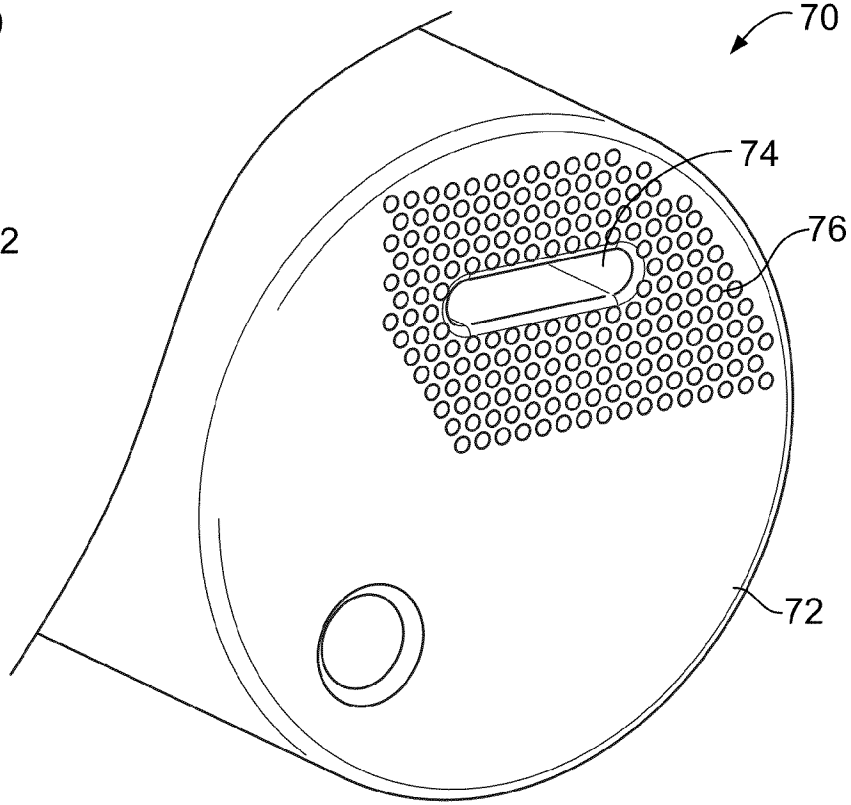
FIG. 7 is a view of another embodiment of a face of a print head assembly.

FIG. 7 shows another embodiment 70 of print head assembly. Perforated area 76 covers a smaller percentage of the surface area of the face 72 than the design shown in FIG. 5. The perforated area 76 is disposed around print opening 74. Perforated area 76 may cover about 30% of the surface area of the face 72.

Figure 8:
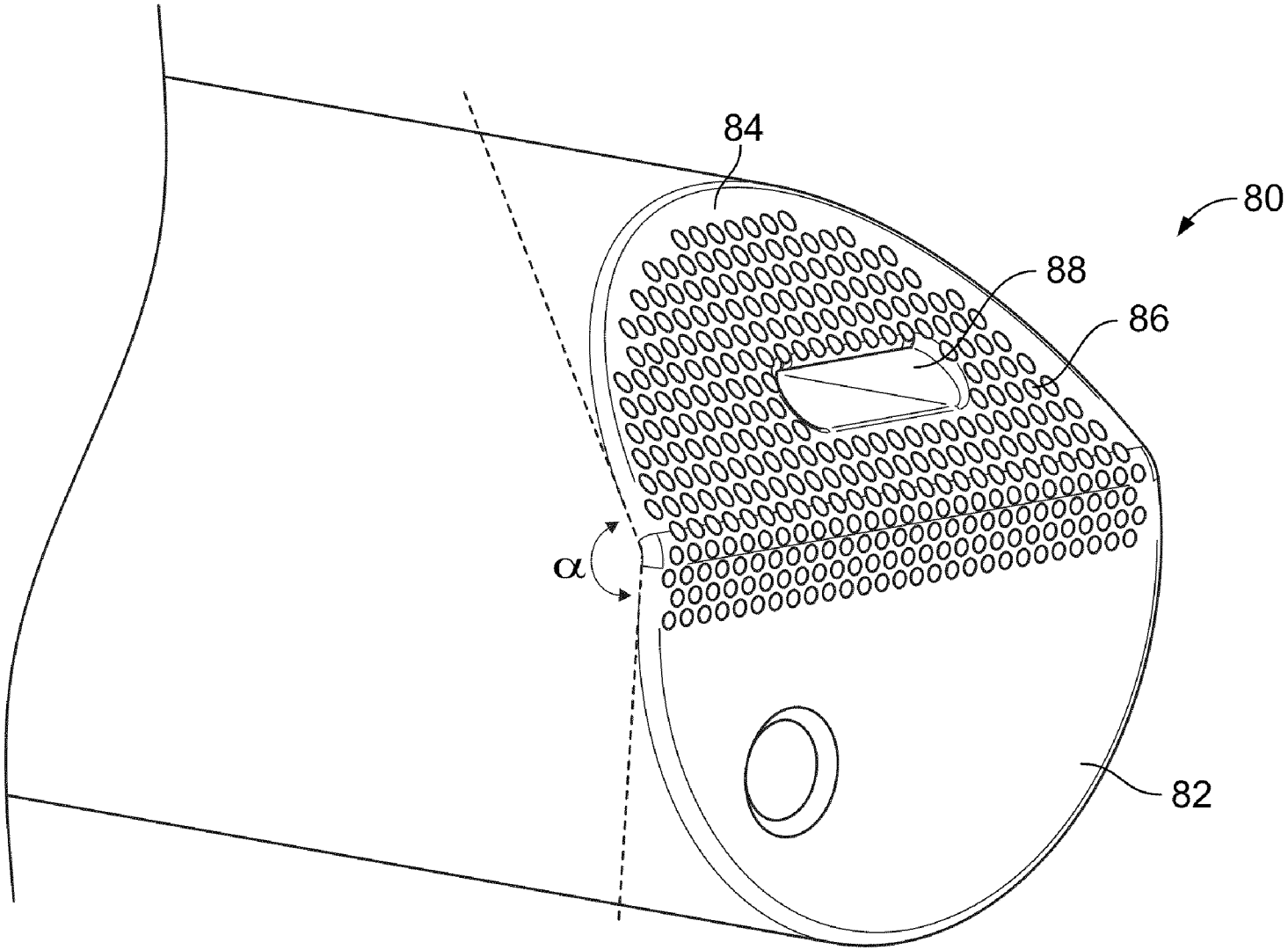
FIG. 8 is a view of another embodiment of a face of a print head assembly.

FIG. 8 shows another embodiment 80 of print head assembly. Print head assembly 80 includes two faces, flat face 82 and angled face 84. Face 84 is angled back away from the flat face 82. Flat face 82 is disposed generally perpendicular to the axis of the print head. Angled face 84 is disposed at an angle a to face 82. The angle $\alpha$ is generally between 135° and 170°, and in one embodiment is about 150°. Print opening 88 is disposed in angled face 84. Perforated area 86 is disposed around print opening 88.

Turning now to how the presently disclosed print head assembly 10 is operated, it may be used in a similar manner to conventional print heads. Pressurized air is preferably provided to the interior 31 of the print head assembly 10, within the print head cover 30. Air flows from the interior 31 of the print head assembly 10 (adjacent the internal components of the print head, and around the ink flow path) through the openings 38 in the perforated area 36. As ink is ejected from the print head 20 through print opening 34, a portion of the ink may splash back upon the face 32 of the print head assembly 10. The air flow around the perforated area 36 prevents buildup of ink and other debris, thus allowing a longer service life and less frequent cleaning of the print head face 32. In one embodiment, the print head cover 30 is substantially free of openings other than those on or adjacent to the face 32.

Figure 9:
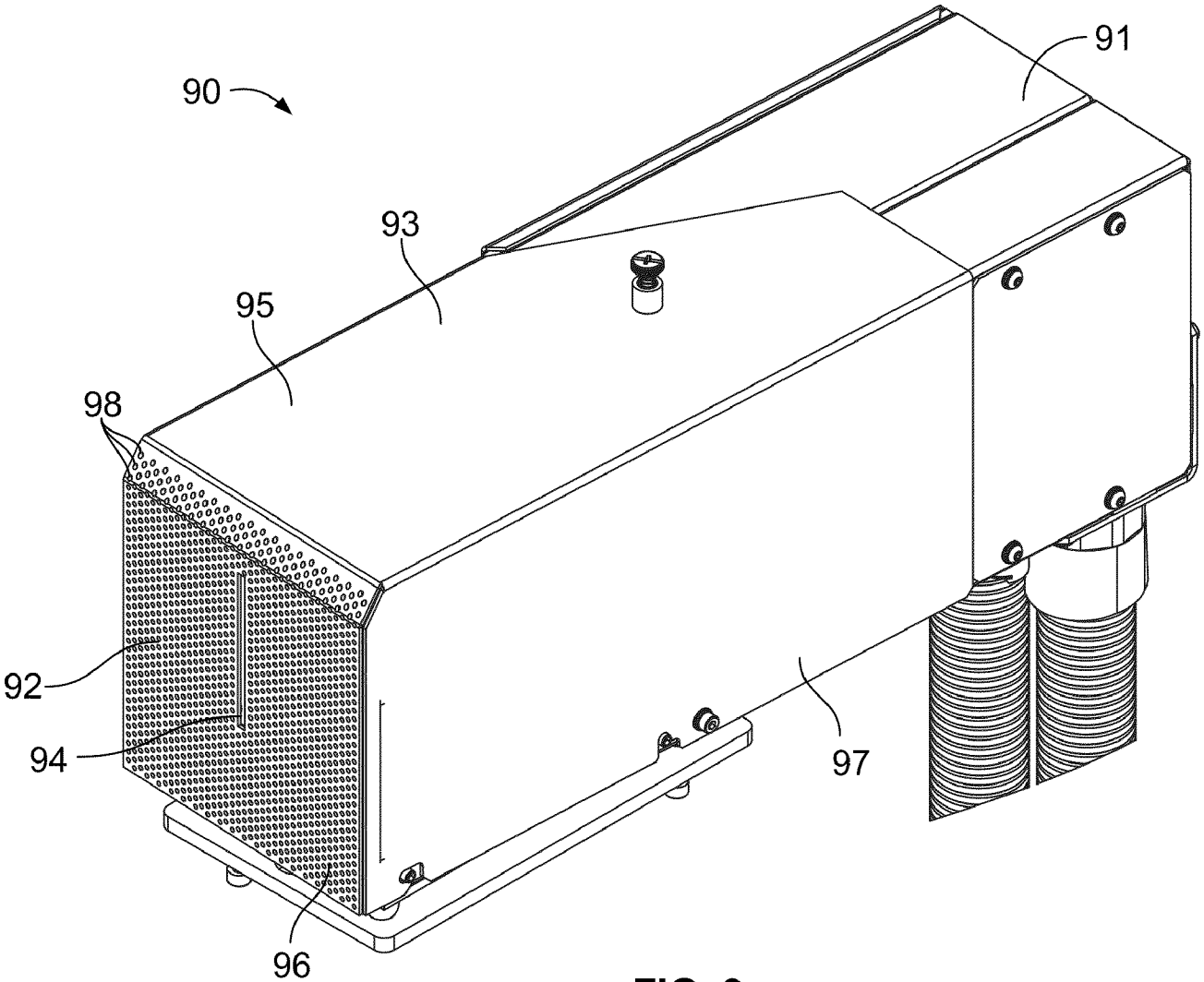
FIG. 9 is a perspective view of another embodiment of a print head assembly.

The perforated cover design may be used with a variety of types of ink jet printers. Beside single-nozzle continuous ink jet, it may also be used with dual or multi-nozzle continuous ink jet printers. Additionally, it may be used with binary array printers, which uses a plurality of nozzles disposed in a linear array. An embodiment of a binary array print head assembly 90 is shown in FIG. 9. Print head assembly 90 includes print head 91 and print head cover 93 surrounding print head 91. Print head cover 91 is generally rectilinear in shape with sides 95, 97 disposed perpendicular to each other and also perpendicular to face 92. Face 92 includes a linear print opening 94 disposed adjacent an exit point or nozzle of the underlying print head. A perforated area 96 is disposed on the face 92. The perforated area 96 is preferably disposed around the print opening 94 and may cover the entire surface of the face 92. The print opening 94 may be any suitable shape to allow ink to be ejected from the ejection point of the print head through the face 92 of the print head cover 90. The ink may be ejected in a direction generally perpendicular to the face 92. The perforated area 96 may be provided by a plurality of holes 98. Holes 98 may have similar qualities as previously described holes 38.

Figure 10:
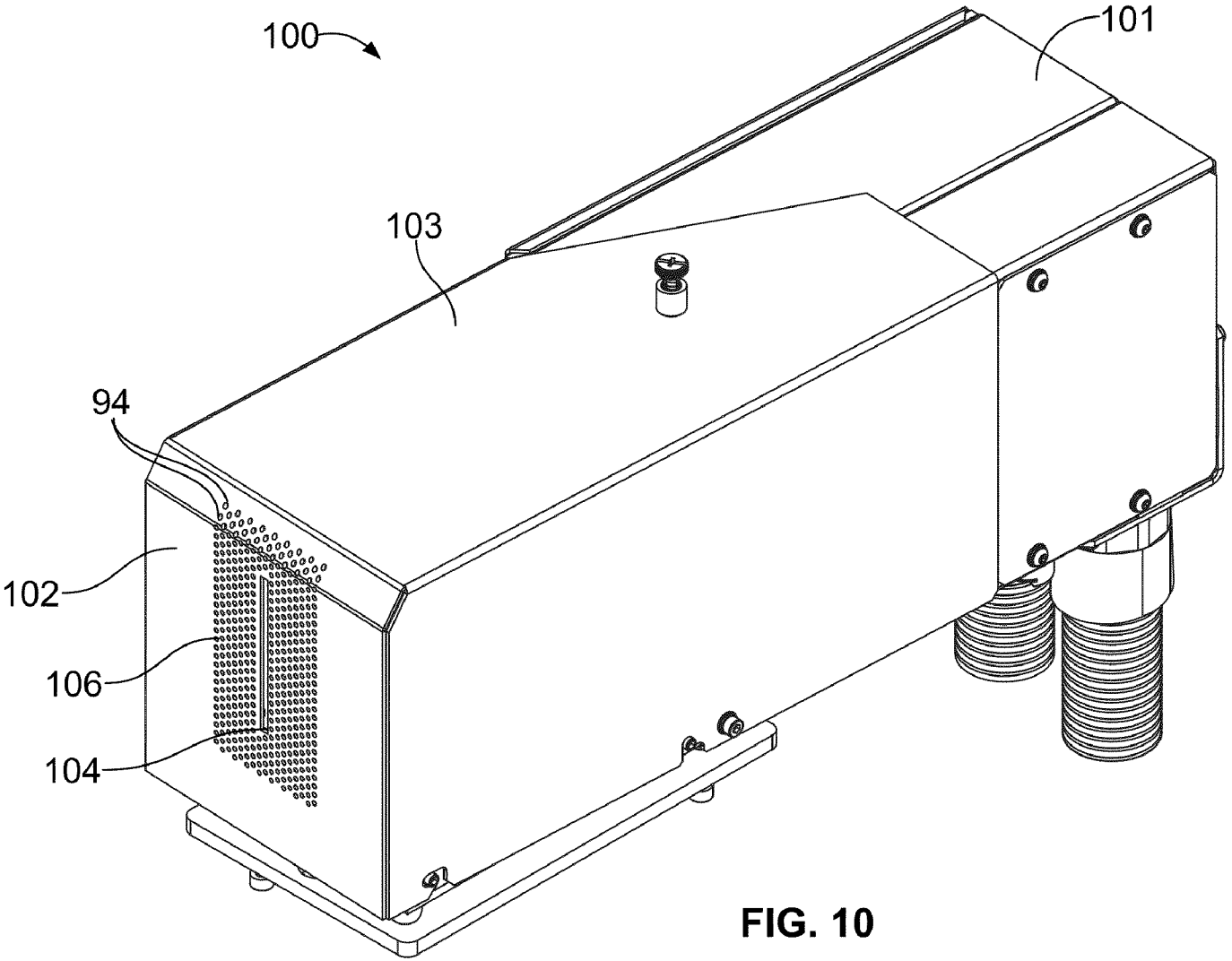
FIG. 10 is a perspective view of another embodiment of a print head assembly.

Another embodiment of a binary array print head assembly 100 is shown in FIG. 10, which is generally similar to the design shown in FIG. 9. Print head assembly 100 includes print head 101 and print head cover 103. Face 102 includes a linear print opening 104 disposed adjacent an exit point or nozzle of the underlying print head. A perforated area 106 is disposed on the face 102. The perforated area 106 is preferably disposed around the print opening 104. The perforated area 106 may be provided by a plurality of holes 98. The perforated area 106 only covers a portion of the area of the face 102. The perforated area 106 covers generally about 50% of the area of the face 102, and the perforated area 106 may be in the shape of a rectangle. In general, the perforated area 106 is disposed on at least 20% of the surface area of the face 102. The perforated area 106 preferably includes at least 10% and 40% open area.

As in the previously described examples, the print head assemblies 90 and 100 provide air flow through the perforated areas 96, 106 to reduce the accumulation of air and other debris on the face of the print head.

The print head assemblies disclosed herein may be prepared by any suitable method. The material of the print head cover 30 is preferably steel, most preferably stainless steel, but other materials are possible.

EXAMPLES

Videojet® 1510 and 1610 continuous ink jet printers were set up for printing on a substrate using three types of print head cover. Comparative Example A used a conventional print head cover with no perforated area around the print head opening, as illustrated in FIG. 6. Example 1 used a perforated print head cover as illustrated in FIG. 5. Example 2 used a perforated print head cover as illustrated in FIG. 4. Each test included a 60 μm nozzle and a throw distance of 12 mm from the substrate. To perform an accelerated test, the substrate was charged at −300 Volts and disposed on a rotating drum. This accelerated test provided much harsher conditions than a print head would experience under normal operating conditions. For Examples 1 and 2, air flow was provides through the perforated area.

Figure 12:
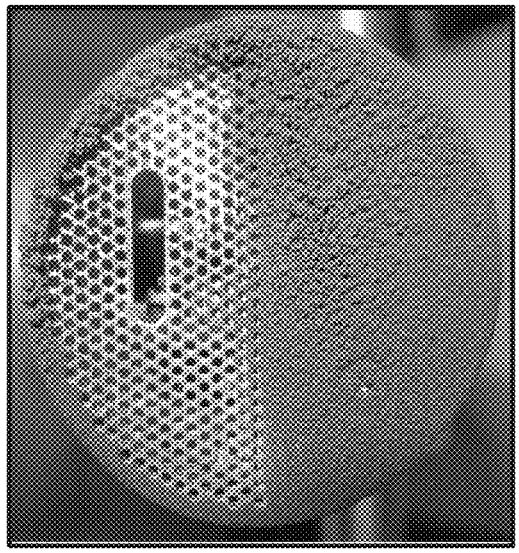
FIG. 12 is a view of the face of the print head assembly of FIG. 5 used in Example 1.
Figure 11:
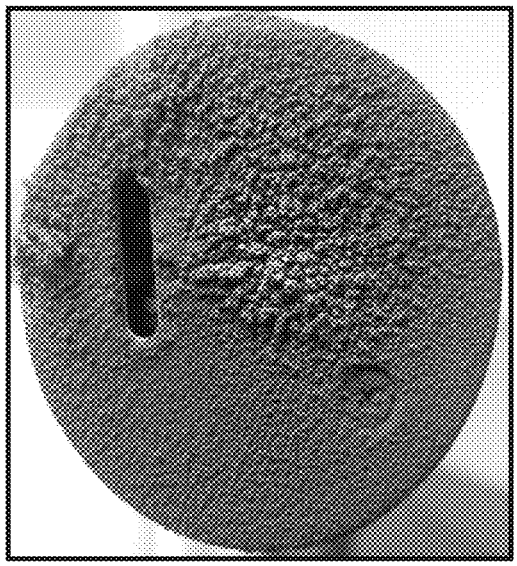
FIG. 11 is a view of the face of a prior art print head assembly used in Comparative Example A.

For Comparative Example and Example 1, the printer was run for a period of 9 hours with a 1510 printer and the buildup of ink on the print head face was evaluated. The result for a non-perforated print head of Comparative Example A is shown in FIG. 11 and for a perforated print head of Example 1 is shown in FIG. 12. From FIG. 11, it can be seen that the conventional print head had significant accumulation of debris on the print head face. From FIG. 12, it can be seen that the inventive print head had much less accumulation of debris on the print head face, with almost no accumulation in the perforated area adjacent the print opening, compared to the conventional print head of Comparative Example A.

Figure 13:
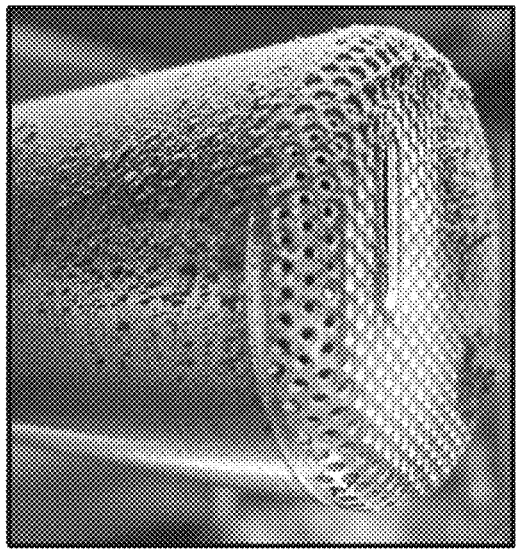
FIG. 13 is a perspective view of the face of the print head assembly of FIG. 1 used in Example 2.

Example 2 used a perforated print head cover as illustrated in FIG. 4 with the same operating conditions as described above for Example 1, with a 1610 printer. The printer was run for a period of 20 hours and the buildup of ink on the print head face was evaluated. The result for the perforated print head of Example 2 is shown in FIG. 13. From FIG. 13, it can be seen that the design of Example 2 had very little accumulation of debris on the print head face, with almost no accumulation in the perforated area adjacent the print opening.

Thus, it can be seen that the design of Examples 1 and 2 allowed much longer uptime for a printer, and required less cleaning, than the conventional print head of Comparative Example A.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A print head assembly comprising:
a print head;
a print head cover disposed around the print head, the print head cover comprising:
a face;
a print opening disposed in the face and adjacent an ejection point of the print head; and
a perforated area disposed on the face adjacent the print opening;
wherein the print head assembly includes an interior volume in fluid communication through the perforated area with an ambient environment, to provide air flow from the interior volume through the perforated area.

2. The print head assembly of claim 1 wherein the perforated area comprises a plurality of holes disposed in the face.

3. The print head assembly of claim 2 wherein the holes are dimensioned between 0.5 mm and 1.0 mm in diameter.

4. The print head assembly of claim 1 wherein the face has a surface area, wherein the perforated area covers at least 40% of the surface area of the face.

5. The print head assembly of claim 4 the perforated area covers substantially all of the surface area of the face.

6. The print head assembly of claim 1 wherein the face is circular in shape and the perforated area is generally semicircular in shape.

7. The print head assembly of claim 1 wherein the perforated area completely surrounds the print opening.

8. The print head assembly of claim 1 wherein an air pressure of the interior volume is greater than an air pressure of the ambient environment.

9. The print head assembly of claim 1 wherein the perforated area comprises at least 15% open area.

10. The print head assembly of claim 1 wherein the print head cover is generally cylindrical in shape and the face is generally circular in shape.

11. The print head assembly of claim 1 wherein the print head cover is generally rectilinear in shape and the face is generally rectangular in shape.

12. The print head assembly of claim 1 wherein the print head is a continuous ink jet print head.

13. The print head assembly of claim 1 wherein the print head is a binary array print head.

14. The print head assembly of claim 1 wherein the print head is oriented along a central axis within the print head cover.

15. The print head assembly of claim 1 wherein the face of the print head comprises a first portion oriented generally perpendicular to an axis of the print head, and a second portion disposed at an angle between 135° and 170° with respect to the first portion.

16. The print head assembly of claim 1 further comprising an ink droplet generator, a charge electrode, deflector plates, a phase measurement system, and a gutter, disposed within the print head.

17. A method of operating a print head comprising:
providing a print head assembly comprising:
a print head;
a print head cover, the print head cover comprising a face; and a print opening disposed in the face, the print opening disposed adjacent a an ejection point of the print head;

providing ink to the print head;

ejecting ink from the ejection point of the print head through the print head cover;

providing a flow of air adjacent the ejection point from an interior of the print head assembly to an exterior of the print head assembly; and depositing ink on a substrate.

18. The method of claim 17 further comprising providing pressurized air to the print head assembly.

19. The method of claim 18 further comprising providing a flow of air out of the print head assembly through a perforated area in the face of the print head assembly.

20. The method of claim 19 wherein the flow of air is generally parallel to a path of the ejected ink.

21. The method of claim 19 wherein the accumulation of debris on the print head is substantially less than it would be on the same print head without the perforated area.

* * * * *